US010820775B1

(12) United States Patent
Gilbert et al.

(10) Patent No.: US 10,820,775 B1
(45) Date of Patent: Nov. 3, 2020

(54) DEVICE FOR USE WITH A FLOOR CLEANER FOR CATCHING DEBRIS

(71) Applicants: Eugene W. Gilbert, Nampa, ID (US); Treva L. Gilbert, Nampa, ID (US)

(72) Inventors: Eugene W. Gilbert, Nampa, ID (US); Treva L. Gilbert, Nampa, ID (US)

( * ) Notice: Subject to any disclaimer, the term of this patent is extended or adjusted under 35 U.S.C. 154(b) by 324 days.

(21) Appl. No.: 15/944,213

(22) Filed: Apr. 3, 2018

Related U.S. Application Data

(63) Continuation-in-part of application No. 14/059,605, filed on Oct. 22, 2013, now abandoned.

(51) Int. Cl.

| | |
|---|---|
| ***A47L 13/12*** | (2006.01) |
| ***A47L 13/50*** | (2006.01) |
| ***A47L 13/38*** | (2006.01) |
| ***A47L 13/24*** | (2006.01) |

(52) U.S. Cl.
CPC ..... *A47L 13/50* (2013.01); *A47L 13/12* (2013.01); *A47L 13/24* (2013.01); *A47L 13/38* (2013.01)

(58) Field of Classification Search
CPC ..... A46B 2200/302; A47L 13/24
See application file for complete search history.

(56) References Cited

U.S. PATENT DOCUMENTS 1,024,454 A 4/1912 Meyer
2,090,412 A * 8/1937 Geiger ..... B25G 1/06 15/146
3,324,494 A * 6/1967 Vosbikian ..... A47L 13/52 15/105
3,979,146 A * 9/1976 Berg ..... E01H 12/00 209/418
4,369,109 A 1/1983 Edge
4,724,566 A * 2/1988 Fawcett ..... E04H 4/1609 15/1.7
D302,059 S * 7/1989 Sanders ..... D32/51
5,342,513 A * 8/1994 Wall ..... E04H 4/1609 15/1.7
5,614,085 A * 5/1997 Platt, III ..... A47L 13/52 15/104.8
D585,168 S 1/2009 Bar-Noy et al.
7,836,540 B2 * 11/2010 Vasilakes ..... A46B 15/0002 15/1.52
8,056,178 B2 11/2011 Bar-Noy et al.
8,100,446 B1 1/2012 Moore et al.
(Continued)

*Primary Examiner* — Michael D Jennings
(74) *Attorney, Agent, or Firm* — Pedersen & Company, PLLC; Ken J. Pedersen; Barbara S. Pedersen

(57) ABSTRACT

An apparatus traps items missed by standard manual floor cleaners, by catching debris that goes over a top surface of a floor cleaner head. The preferred apparatus is adapted for a conventional dust mop with a pivotal/swing handle, and has a connection system with an elongated vertical slot extending parallel to the right-to-left length of the dust mop head and allowing the pivotal/swing handle to freely slide right and left in the slot. The preferred apparatus is also pivotal forward and rearward relative to the dust mop head so that the apparatus pivots forward and rearward with the handle when the handle pivots forward and rearward. The combination of the dust mop and debris-catching apparatus provide great versatility in mopping and debris-catching direction and orientation, including low to the floor under furniture, equipment, or other objects.

21 Claims, 15 Drawing Sheets

(56) References Cited

U.S. PATENT DOCUMENTS

| | | | | |
|---|---|---|---|---|
| 8,196,249 | B1 * | 6/2012 | Spooner | A46B 17/08 15/117 |
| 8,438,689 | B2 * | 5/2013 | Noble | A46D 1/02 15/105 |
| 8,689,533 | B2 | 4/2014 | Abughazaleh | |
| 9,375,076 | B2 * | 6/2016 | Weis | A46B 9/04 |
| 2003/0164176 | A1 | 9/2003 | Arbon | |
| 2004/0250365 | A1 * | 12/2004 | Anderson | A46B 15/0081 15/111 |

* cited by examiner

DEVICE FOR USE WITH A FLOOR CLEANER FOR CATCHING DEBRIS

This application is a Continuation-in-Part of U.S. Non-Provisional application Ser. No. 14/059,605, filed Oct. 22, 2013, the entire disclosure of which is incorporated herein by this reference.

BACKGROUND OF THE INVENTION

Field of the Invention

The present invention relates to the field of manual floor cleaners, and particularly to manual dust mops. More specifically, the invention relates to a device/accessory configured to trap litter or debris that might otherwise roll or float over the cleaning head/pad of the floor cleaner.

Related Art

The patent literature discloses attachments for brooms. See Sanders Pat. No. D302059, issued Jul. 4, 1989, which discloses a device fixed to a broom by a rigid triangular bracket clamped to the not-pivotal broom handle. See also Meyer U.S. Pat. No. 1,024,454, issued Apr. 23, 1912, which discloses a dust-catching attachment fixed by a rigid clamp system to the broom bristles of a broom with a non-pivotal handle.

SUMMARY OF THE INVENTION

The invented device comprises a trapping system for catching litter/debris that typically is not captured during use of a manual floor cleaner. The device is especially beneficial for trapping lightweight litter/debris that floats/rolls over the top, and falls behind, the cleaning head/pad of a floor cleaner. The device is adapted to be particularly effective on a floor cleaner that has a pivotal handle, by not interfering with use of the cleaner while the user pivots the handle and pushes/pulls the floor cleaner in many directions and orientations.

In certain embodiments, the device is adapted to catch litter/debris when the user is pushing the floor cleaner quickly and/or forcefully, resulting in quick/forceful air flow over the top of the head/pad of the floor cleaner that therefore carries light litter/debris up above and/or over the cleaner head/pad. Therefore, the preferred embodiment of the device is especially-well adapted for use with a conventional pivot-handle dust mop. Such conventional pivot-handle dust-mops have a low-profile dusting head/pad that catches and carries dust and pushes heavy items such as cans or dropped food along in front of it, but that allows light-weight litter/debris to float over said head/pad instead of getting caught by, or pushed along, by the head/pad. Such light-weight litter/debris may include, for example, cellophane, plastic wrap, onion peels, paper, receipts, facial tissues, etc.

The device comprises a catching portion that is especially effective for said light-weight litter/debris, and a connection system for connecting the device to the floor cleaner. The preferred catching portion comprises a long, planar or generally planar member that extends from a location at or close to the top of the cleaner head/pad, upward at least several inches and toward the handle, to intercept and thereby catch the floating/rolling litter/debris. The connection system connects the lower portion or edge of the catching portion to the cleaner head/pad and the upper portion or edge of the catching portion to the cleaner handle, in a way that allows the catching portion to pivot with the handle forward and rearward/backward relative to the head/pad and that allows the handle to pivot side-to-side relative to said catching portion and said head/pad.

Preferably, the connection system is adapted so that the device is easily attachable to and detachable from the conventional floor cleaner. Thus, the device may be provided as an accessory for addition to a conventional floor cleaner, such as a conventional dust mop; such detachability will be beneficial for many users who already own or are supplied with conventional floor cleaners by an employer. Such detachability also will be effective for cleaners that feature heads/pads that are conventionally removed for cleaning or replacement, so that the device does not interfere with the removal/replacement. In certain embodiments, the device may be original equipment manufacture (OEM) for conventional cleaners and/or specialty cleaners.

These and/or additional objects, features and advantages of the device will be readily apparent to those of ordinary skill in the art upon reading the following detailed description of the presently-preferred embodiments when taken in conjunction with the accompanying drawings.

BRIEF DESCRIPTION OF THE DRAWINGS

The accompanying drawings, which are included to provide a further understanding of the invention are incorporated in and constitute a part of this specification, illustrate several, but not all, embodiments of the invention and together with the description serve to explain the principles of the invention.

DETAILED DESCRIPTION OF CERTAIN EMBODIMENTS

Figure 1:
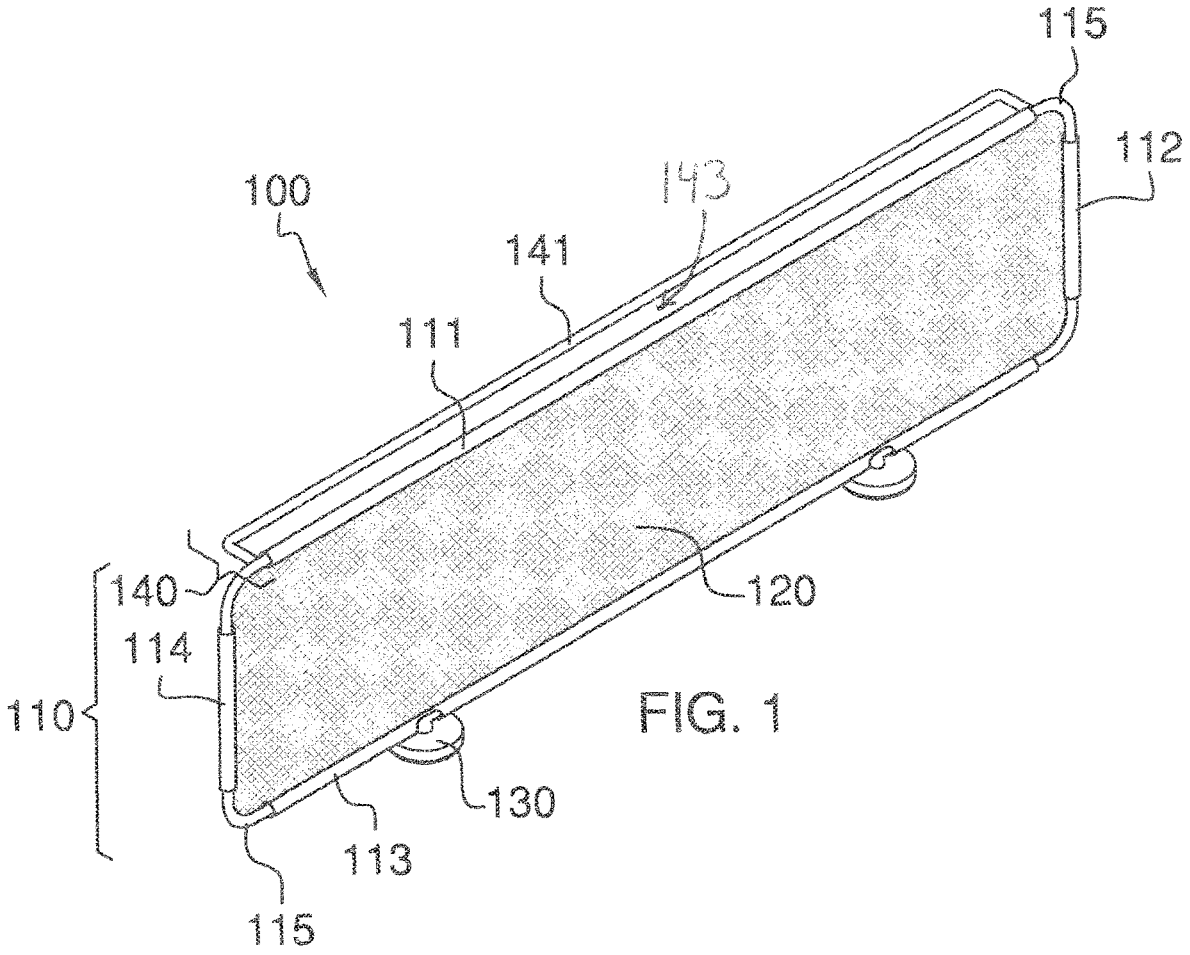
FIG. 1 is an isometric view of one embodiment of the device, detached from any floor cleaner.
Figure 2:
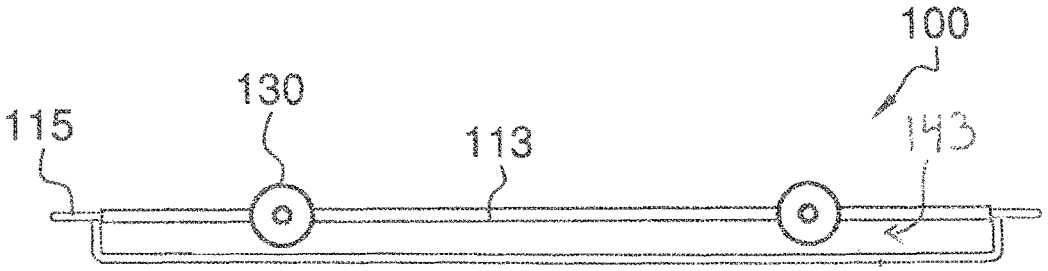
FIG. 2 is a bottom view of the device of FIG. 1.
Figure 3:
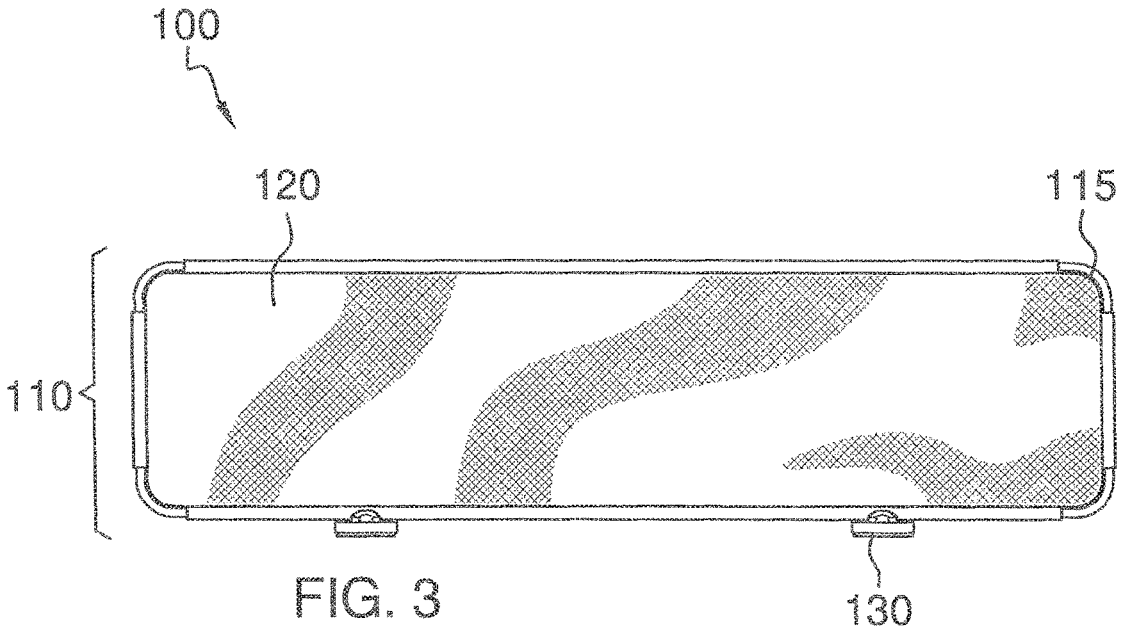
FIG. 3 is a front view of the device of FIG. 1.
Figure 4:
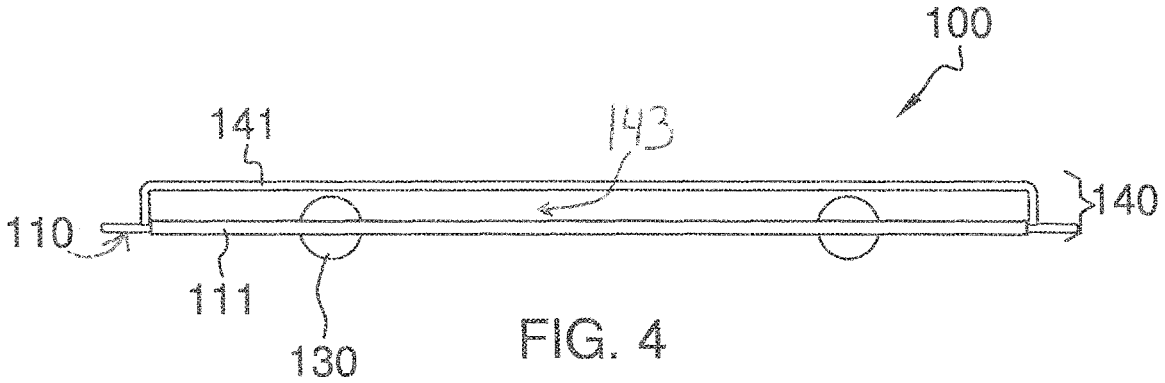
FIG. 4 is a top view of the device of FIG. 1.

Referring to the Figures, there are shown several, but not the only, embodiments of the invented device. It will be noted that the largest dimensions of the floor cleaner/dust mop head, and the largest dimension of the device, are referred to in this Detailed Description as the "length" of the head and device, respectively. The lengths of the head and the device are parallel (or generally parallel) to each other, and parallel (or generally parallel) to the floor, and the lengths of the head and of the device are transverse to what is understood to be the forward and rearward directions of mopping. Note that the length of the device 100 extends between right and left edges of the drawing sheet in FIGS. 2, 3 and 4, and that the device 100 length will be understood to be parallel (or generally parallel) to the length 202 of the floor cleaner head in FIG. 5.

FIGS. 1-6 show an embodiment of the device 100 detached from any floor cleaner, and also connected to schematically-drawn floor cleaners. As illustrated in FIGS. 1-6, device 100 includes a catching portion that comprises a frame 110, and a trapping surface 120 mounted on the frame 110. It may be noted that the trapping surface 120 may also be referred to as a "trapping member", "trapping plate", or "trapping wall", and both the front surface/side and rear surface/side of the trapping surface/member/plate/wall may be operative to capture debris. Also illustrated in FIGS. 1-6, device 100 includes a connection system that comprises mounting devices 130 at the lower end of the device 100 for connection to the floor cleaner heads 200, 200' and an upper connector 140 that includes/defines an elongated, vertical aperture, or slot 143, for receiving the handle 201 of the cleaner. When properly mounted by means of both the mounting devices 130 and the upper connector 140, device 100 performs by: 1) trapping litter or debris (hereafter, for simplicity, "debris") that comes up and over the top of the floor cleaner head toward and against the device 100, and, 2) importantly, allowing pivoting of a pivotal handle forward, rearward, and sideways for versatile and varied use of the floor cleaner, as will be further discussed later in this document.

Figure 5:
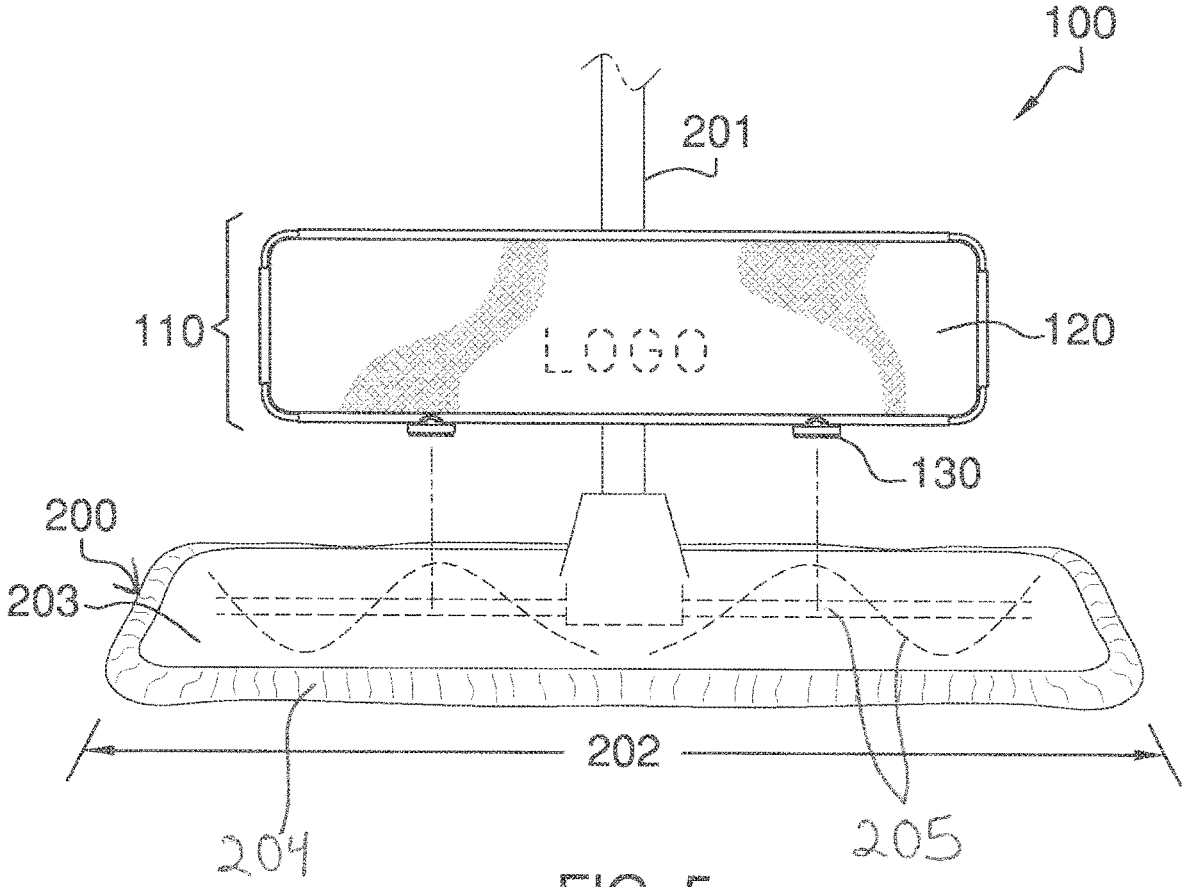
FIG. 5 is an in-use view of the device of FIG. 1, being installed on an exemplary, schematically-drawn floor cleaner.
Figure 6:
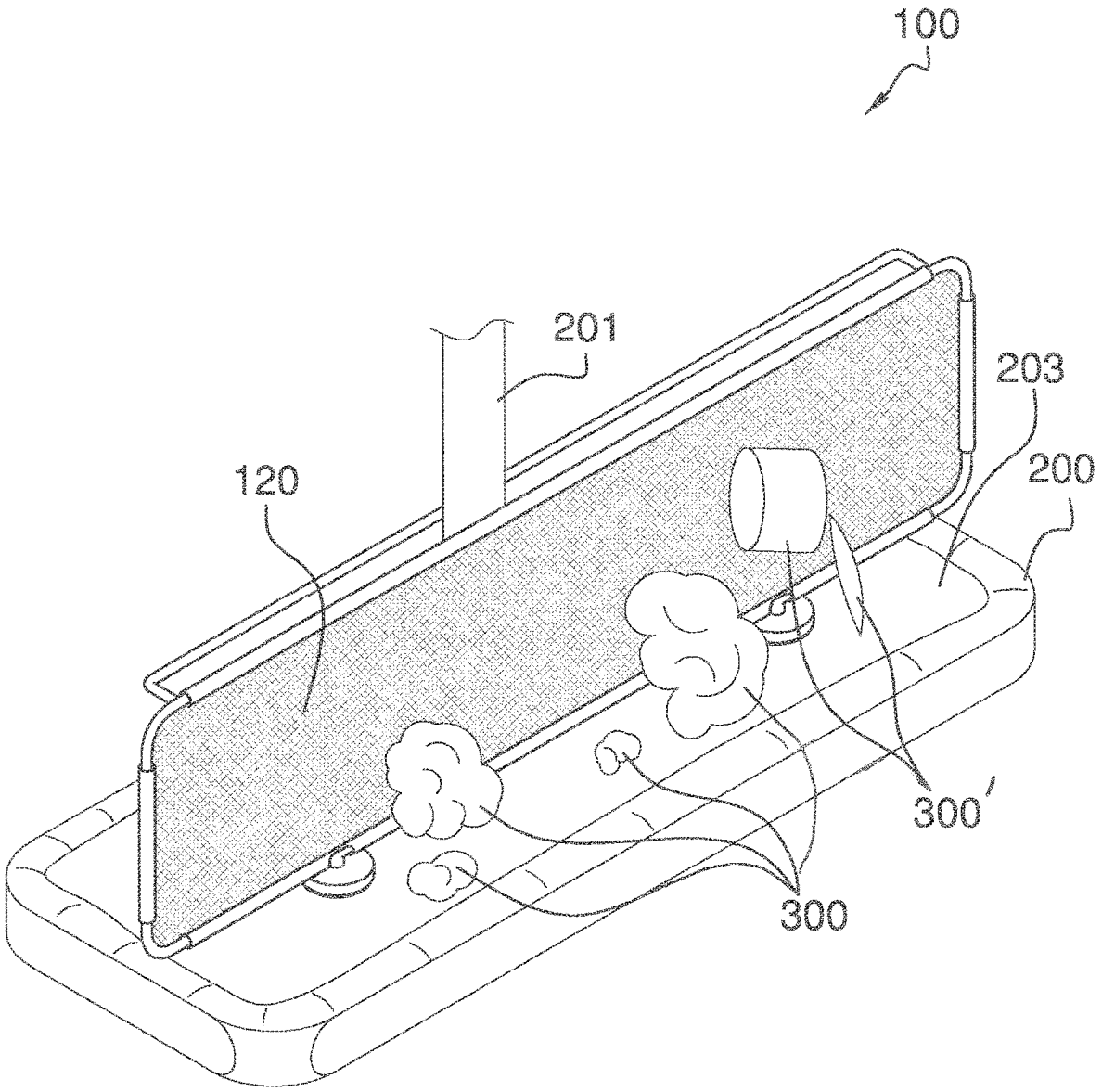
FIG. 6 is an in-use, perspective view of the device of FIG. 1, installed on an exemplary, schematically-drawn floor cleaner and in use catching debris.

In FIGS. 1-6, the multiple mounting devices 130 are provided in spaced-apart locations across the length of the device 100, at the bottom edge of the device 100. As shown in FIGS. 5 and 6, the mounting devices 130 connect the device 100 to multiple spaced-apart locations along the length 202 on the top surface 203, 203' of the heads 200, 200'. Preferably, the mounting devices 130 detachably secure the device 100 as long as desired by the user or owner of the floor cleaner. Many materials/methods exist for this purpose, for example, magnets, clips and hook and loop tape. Magnets are beneficial for embodiments used on conventional dust mops, as they may magnetically connect, through the fabric dust mop cover 204, to the conventional metal inner frame 205 that carries and shapes the cover 204 installed over and around the frame 205.

In certain embodiments, the magnets/mounting devices 130 are immovably fixed to the device 100, for example, fixed to the device frame 110. In such embodiments, the magnetic connection to the cleaner head frame 205 allows the magnets/mounting devices 130, and hence the device 100 and its frame 110, to rotate relative to the frame 205 for forward and rearward pivoting of the device 100 relative to the head 200, 200'. In certain embodiments, the magnets/mounting devices 130 are pivotally connected to the device 100, for example, pivotally connected to the device frame 110. In such embodiments, the device 100/frame 110 may pivot relative to the magnets/mounting devices 130 and the head 200, 200', with the magnets/mounting devices 130 remaining in place (or generally in place) relative to the frame 205 and head 200, 200' while the device 100/frame 110 pivots.

In FIGS. 1-6, the upper connector features a vertical aperture (or "slot" 143 extending from top to bottom through the upper connector) for receiving the handle 201 of the floor cleaner, and for allowing the handle to pivot forward and rearward, and side-to-side, to an extent allowed by the handle connection to the cleaner head. The preferred handle connection, with two pivot axles, will allow 360 degrees, or nearly 360 degrees, of pivoting relative to the floor cleaner head, and the preferred device 100 causes little or no interference with this pivoting, as will be further discussed below. For example, in a top view looking down on the dust mop and the floor, the preferred handle first pivot axle for forward and rearward pivoting and second pivot axle for left and right pivoting will, in combination, allow the handle to pivot 360 degrees around the floor cleaner head. For example, the outermost extremity end of the handle could be pivoted in a 360 degree circle in a horizontal plane parallel to the top plane of the dusting head and parallel to the floor.

The upper connector is not clamped onto, bolted to, immovably fastened to the handle, or otherwise fixed to the handle, but instead allows free movement of the handle relative to the device 100 through and along the entire length of the slot of the upper connector. This way, the slot 143 may be described as a "track" along which, and through which, the handle can pivot/slide/travel while the dust mop head stays substantially or entirely parallel to the floor.

Once connected to the floor cleaner, the device 100 is configured to catch debris that would otherwise float or fall over top of the floor cleaner 200. Preferred embodiments are used on a dust mop, which is traditionally used for dusting, that is, catching and/or picking up dust and particulate or fine granular material in its dust mop cover cloth and fibers. However, many environments where a dust mop is used will also include larger debris on the floor or other surface to be cleaned. When said larger debris is light-weight, for example, cellophane, plastic wrap, onion peels, paper, receipts, facial tissues, etc., it will typically be caught by the device 100. When said larger dirt and debris is a heavy object, such as an empty aluminum beverage can, the can will typically be pushed along by the dusting head/pad, and the user will pick it up immediately, or push it to a recycle or waste bin so that he/she may pick it up there and dispose of it.

Therefore, debris that is most likely to be caught by the device 100 is schematically portrayed in FIG. 6 as debris 300 and will be light-weight debris 300 such as cellophane, plastic wrap, onion peels, paper, receipts, facial tissues, etc. Because of the air flow toward the trapping surface 120 during dust mop use, the light-weight of debris 300, and the plane of the trapping surface typically upending relative to the head 200, 200' but typically somewhat reclined at an angle to the floor, said debris 300 will tend to waft up to the trapping surface 120 and will tend to remain there until the user reaches a recycle/garbage bin and picks up the debris 300 for deposit in the bin. Heavy debris, such as the can 300' shown in FIG. 6, may occasionally pop up toward the device 100 when hit by the head 200', and/or may simply instead be pushed along in front of the floor cleaner head 200'. Even if the heavy debris 300' does pop up to the trapping surface 120 as shown in FIG. 6, it may fall down to be pushed ahead by the head 200, 200' and/or be picked up by the user.

The catching portion trapping surface 120 may be one or more piece(s)/plate(s)/sheet(s) of fabric, flexible fabric, net, mesh, plastic, or other material against which debris 300 tends to remain while the cleaner is being pushed along the floor. In certain embodiments, the catching portion trapping surface 120 is planar or generally planar, light-weight, flexible and/or textured, and/or have a shape that tends to catch the light-weight debris 300 that floats/rolls up to the surface 120. In certain embodiments, the trapping surface 120 is net or mesh or loosely-woven material, as it had a texture that tends to hold the debris against it but does not create much air resistance to the user pushing the dust mop and the device forward. It may be noted that "mesh" may be defined as a surface/material with a large number of closely spaced holes. Mesh is often made of strands of metal, fiber, yarn, or other flexible and/or ductile material but can also be formed directly from plastics or other materials. It may be noted that "net or netting" may be defined as a specific type of mesh material wherein the warp and weft yarns are looped or knotted at their intersections. In certain embodiments, however, the trapping surface may be a smooth plate of material without texture, holes, or recesses, as the in-use air flow toward the trapping surface will tend to hold the debris 300 against even a smooth trapping surface. Therefore, in certain embodiments, the trapping surface may be selected from a group consisting of fabric, flexible fabric, textured fabric, net, mesh, plastic, flexible plastic, textured plastic, smooth fabric, and smooth plastic.

The catching portion also preferably comprises a frame 110 around and/or otherwise maintaining the shape and orientation of the trapping surface 120. Several methods to attach the trapping surface 120 to the frame 110 are well known to those skilled in the art, including sewing, heat sealing, clamping, or tying the trapping surface directly onto the frame, for example. The frame 110 may made of a lightweight material such as small metal rods, spring wire, or rigid plastic tubing, for example. It is preferred that that the frame 110 be rigid or semi-rigid to maintain the preferred shape and size of the trapping surface. As explained below, a further role of the frame 110 may be to provide a bar/member that serves as a portion of the connector 140 and defines the front edge of the vertical slot 143.

While the frame 110 and trapping surface 120 may various shapes in certain embodiments, it is expected that the frame 110 and surface 120 will be rectangular or oval in shape, longer than tall, and narrow from front to back. The frame may be made of a single piece in certain embodiments, or multiple pieces in other embodiments. The trapping surface 120 preferably fills/covers the entire space surrounded by the frame 110.

The multiple-piece frame 110 of FIGS. 1-6 may be further described as having a first frame member 111, a second frame member 112, a third frame member 113, a fourth frame member 114, and elbow members 115 that enable connection there between. The elbow members 115 connect the first frame member 111 to the second frame member 112, as well as the first frame member 111 to the fourth frame member 114. The elbow members 115 enable connection of the second frame member 112 to the third frame member 113 as well as the third frame member 113 to the fourth frame member 114. The first frame member 111 is parallel with the third frame member 113. The second frame member 112 is parallel with the fourth frame member 114.

In certain embodiments, the frame 110 may be designed to expand or contract to adjust to the length 202 of the floor cleaner head/pad 200, 200' for example, by using telescopic tubing for the frame 110. Preferably, the catching portion, including its trapping surface 120 and frame 110, has a length, or is expandable to a length, that is generally similar to the length of the head 200, 200', for example, a length that is 60-110%, preferably 60-100%, and more preferably 65-80% of the length 202 of the head 200, 200'. In certain embodiments, the device 100 is shorter in length than the head 200, 200', so that about 6-8 inches of the head 200, 200' extends beyond the device 100 to reach into a toe kick space of a cabinet, for example, as in FIG. 18.

The catching portion, including in certain embodiments the frame 100 and trapping surface 120, may be of various heights between the bottom edge and bottom edge of the catching portion. For example, heights in the range of 5-14 inches, 6-12 inches, or 9-12 inches, have been found effective in combination with a conventional dust mop.

The upper connector 140 plays a key role in the installation and retention of the device 100 on the preferred floor cleaner, that is, a conventional pivot-handle dust mop, by keeping the top edge of the device 100 near the handle 201 but not clamping, fixing, or otherwise immovably anchoring the top edge or any portion of the device 100 to the handle. Support armature member 141 extends rearward from the frame 110, and more specifically, is connected to and extends rearwardly from the first frame member 111. To install the device 100, the floor cleaner handle 201 is inserted up along the back side of the trapping surface 120, into and through the slot 143 between the armature member 141 and the frame member 111. Then, the device 100 is generally centered lengthwise relative to the length of the dust mop head 200, 200', while lowering the device 100 on the handle 201 to the dust mop head 200, 200' until the magnets 130 connect to the mop head 200, 200' by virtue of magnetic attraction to the conventional metal inner frame 205 inside the head 200, 200'. The dust mop plus device 100 is then ready for use.

The preferred upper connector 140 may be described as a bracket, formed by long straight frame member 111, and the long straight main bar of armature member 141 with two ends, surrounding the slot 143. The frame member 111, the main bar of armature member 141, and the slot may all be described as elongated, parallel to each other, much longer than tall (high), and much longer than deep (front to back). The frame member 111 and the main bar of the armature member 141 are relatively close together. For example, preferred frame member 111 and the main bar of armature member 141 are spaced apart all or substantially all along their lengths a consistent distance that is somewhat larger than the diameter of the handle 201, for example, 1.5 to 3 times the diameter of the handle 201. For certain conventional dust mop handles of about 1 inch in diameter, frame member 111 and the main bar of armature member 141 may be about 1.5 to 3 inches apart all along their lengths, creating a slot that is likewise 1.5 to 3 inches deep (from front to back) all along its length. The closed ends of the upper connector 140 and of the slot 143 are provided by end portions of the armature member 141 that bend, preferably at about 90 degrees, to connect the armature member 141 to the frame member 111. This way, the closed-end slot 143 is uniform or substantially uniform all along the length of the upper connector 140 and will smoothly, slidably, and reliably receive the handle 201 while the handle pivots, as will be further illustrated and discussed below. This smooth, slidable, and reliable receiving of the handle for handle pivoting is best accomplished when the armature member 141 is rigid or semi-rigid, and is rigidly or semi-rigidly fixed to the frame 110; this will keep the armature member 141 from bending a significant distance from the frame 110 so that the user's control of the handle will control the location of the device 100 in addition to controlling the head 200, 200'.

Figure 13:
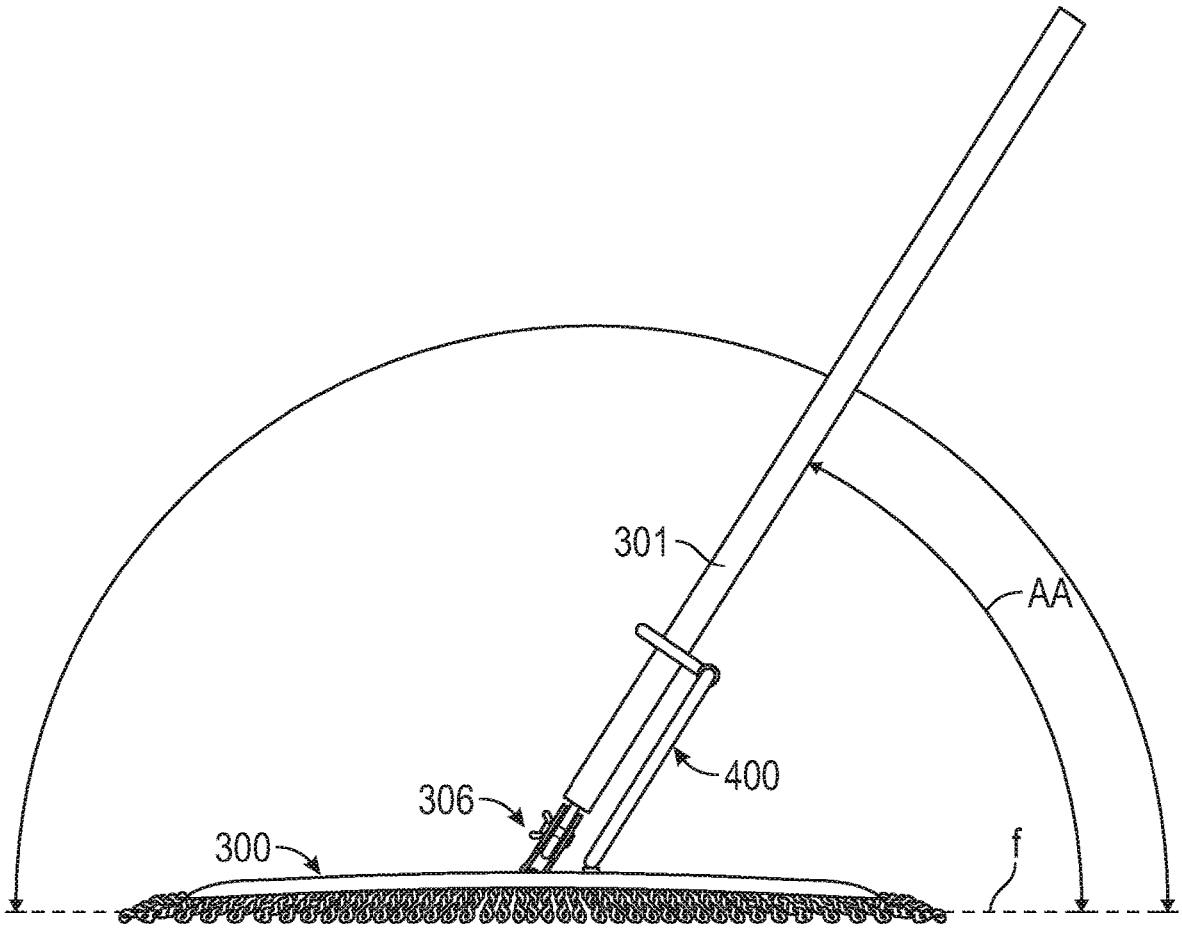
FIG. 13 is a right side view of the dust mop embodiment of FIG. 10, wherein the handle, and the device with it, have been swung forward for use in dust-mopping in a rearward direction opposite of FIG. 12.
Figure 14:
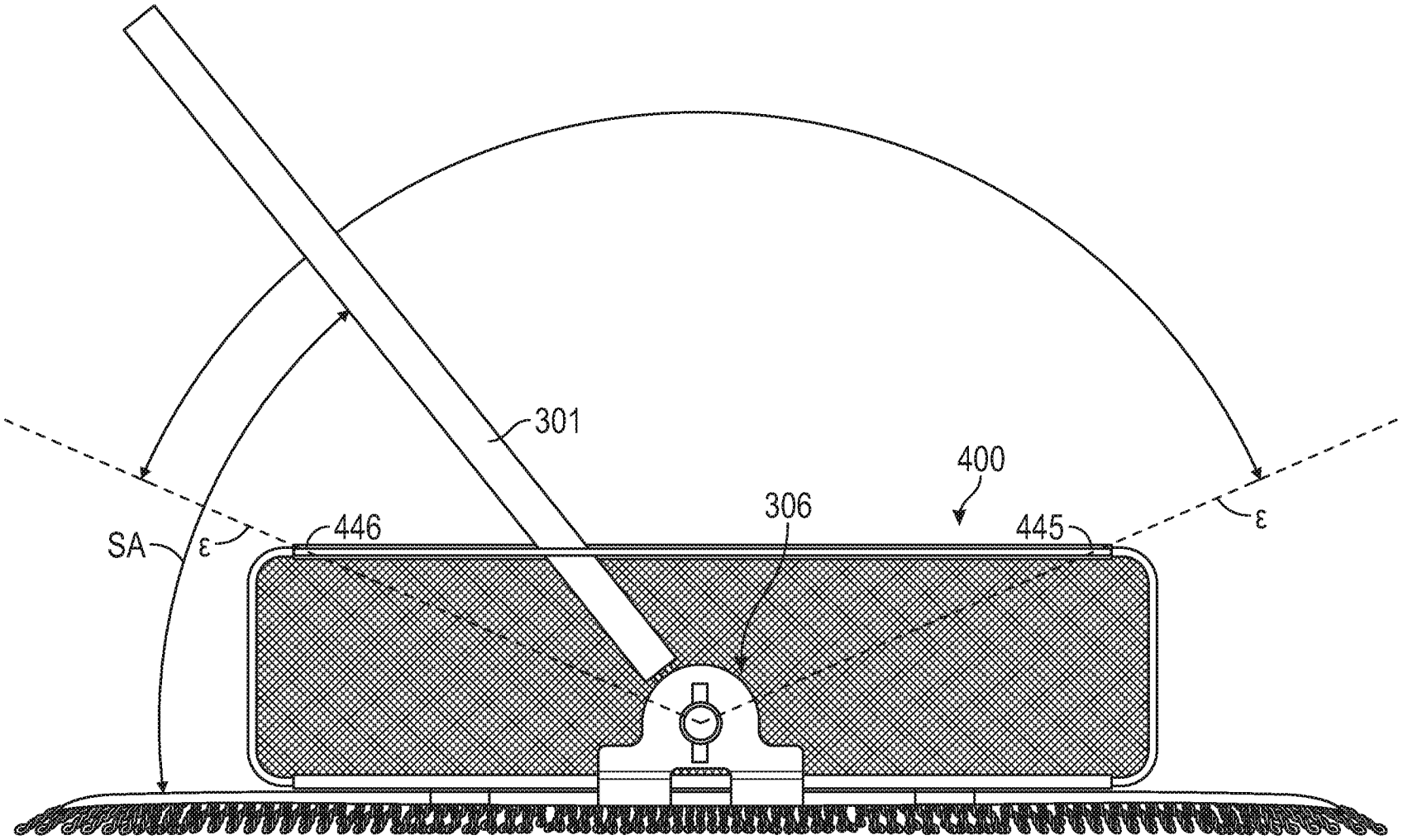
FIG. 14 is a rear view of the dust mop embodiment of FIG. 10, showing that the handle may be pivoted/swung sideways in the slot of the device.

Further, the upper connector 140, including the frame member 111 and armature member 141 are formed by smooth or rounded bars/members, or at least from material that will not gouge or bind with the handle when the handle pivots. Relative movement of the handle 201 relative to the frame member 111 and the armature member 141 occurs both when the handle pivots side-ways, or forward and rearward, so smooth sliding of the handle in the slot 143 is desired. The substantial amount of sliding of the handle relative to members 111, 141 during sideways pivoting of the handle is shown in FIG. 14, and the sliding of the handle relative to members 111, 141 during forward and rearward pivoting will be easily understood from this Description and FIGS. 12 and 13. The lesser, but still significant, sliding of the handle relative to the members 111, 141 that occurs during forward and rearward sliding occurs because the bottom edge of the device 100 is typically connected to the mop head slightly forward of the handle, and this geometry causes a small amount of sliding of the handle, in a direction parallel to the length of the handle, relative to the members 111 and 141 during said forward and rearward handle pivoting.

FIGS. 7-17: Especially-Preferred Dust Mop Embodiment:

An especially-preferred embodiment, portrayed in FIGS. 7-17, comprises a combination of a pivot/swing-handle dust mop 300 and device 400. From FIGS. 7-17, one may see that the handle 301 may move smoothly during use as needed forward and rearward, and right and left, in the slot 443 of the device 400. The handle 301 and the device 400 move generally together in the forward and rearward directions, as they are capable of moving from positions pivoted rearward (see FIG. 12) to be at an obtuse angle OA to the top plane/surface of the mop head and to the floor f forward of the mop, through a position perpendicular to the mop top plane and floor (see FIGS. 10 and 11), to positions pivoted forward (see FIG. 13) to be at an acute angle AA to the mop top plane/surface and the floor f forward of the mop. Preferably, the plane of the catching portion of the device and of the trapping surface of the catching portion, are parallel, or generally parallel (within 15 degrees of parallel), to the longitudinal axis of the handle throughout the entire forward and rearward pivoting of the catching portion and the trapping surface with the handle. Also, in any of these forward, perpendicular, and rearward positions, the preferred handle 201 may move smoothly far to the right and left, to whatever "swing angles" SA the user desires, between the right and left extremities of the slot 443 that are defined by the inner surfaces of end bars 445, 446 of the upper connector 440. Thus, the handle may pivot/swing right and left all the way to the dashed-line extremities E shown in FIG. 14, which may be, for example, at about 25-45 degrees from the floor and top plane of the head 300, for a total right and left pivot/swing in the range of 90 degrees (for extremities E at 45 degrees to the floor) to 130 degrees (for extremities E at 25 degrees to the floor). This right and left pivot/swing range, plus about a 180 degree forward and rearward pivot range discussed below in reference to FIGS. 12 and 13, combine to create in certain embodiments a smooth pivot range for the handle received in the slot 443 in a 360 degree circle around the head 300. Thus, the combination of the preferred dust mop with pivotal handle and the pivotal device is versatile and effective for dust mopping in many directions around and under furniture and cabinets while also catching light-weight debris.

Figure 7:
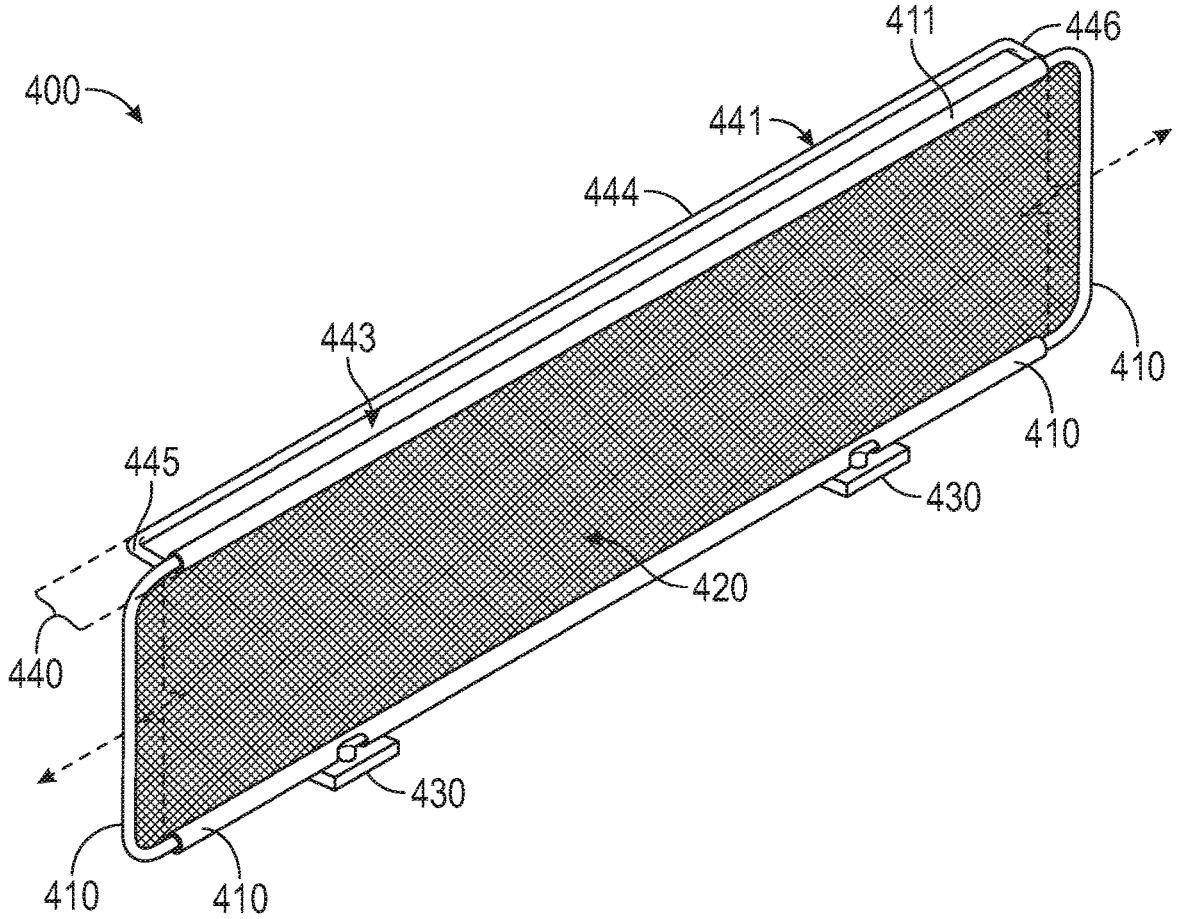
FIG. 7 is an isometric view of an alternative embodiment of the device, detached from any floor cleaner.

Referring to Each of FIGS. 7-18:

FIG. 7 is an isometric view of an alternative embodiment of the device, detached from any floor cleaner. This device 400 includes a frame 410, trapping member 420 such as a mesh, net, flexible fabric, or other sheet/planar material, rectangular mounting magnets 430, upper connector 440 with armature member 441 having a main bar 444 (or "a connector member") connected to the frame member 411 (also a "connector member", wherein connector member 444 and connector member 411 are two straight, parallel, elongated connector members) of frame 410 by end bars 445, 446 to form slot 443. Note that slot 443 may be described as a vertical slot or vertical aperture through the upper connector structure so that the handle may pass vertically through the slot/aperture. Note that preferred slot 443 may be described as having a consistent width (transverse to its length) along the entire length of the slot, as the distance between spaced-apart main bar 444 and frame member 411 is preferably consistent/constant along the entire length of main bar 444 and along the entire length of the portion of the frame 410 (for example, frame member 411) that cooperates with main bar 444 to form the slot 443. Device 400 is portrayed in FIG. 7 as having an optional frame-telescoping feature, wherein the frame could telescope or otherwise adjust in length (see dashed line arrows) and the trapping member 420 could include additional fabric/mesh to accommodate the length adjustment (see dashed lines on trapping surface 420).

Figure 8:
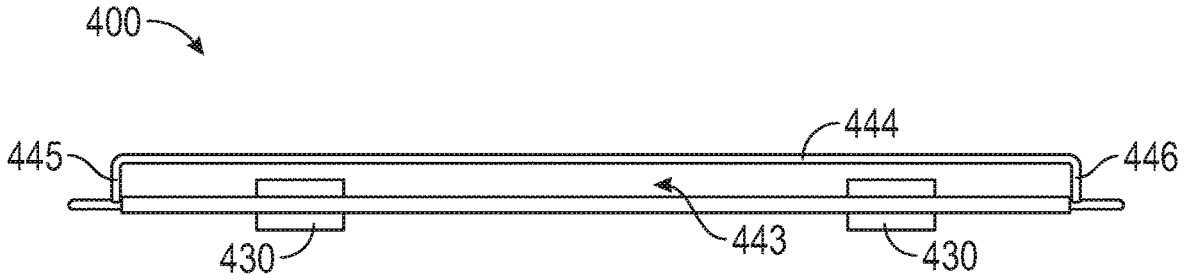
FIG. 8 is a top view of the device of FIG. 7

FIG. 8 is a top view of the device of FIG. 7.

Figure 9:
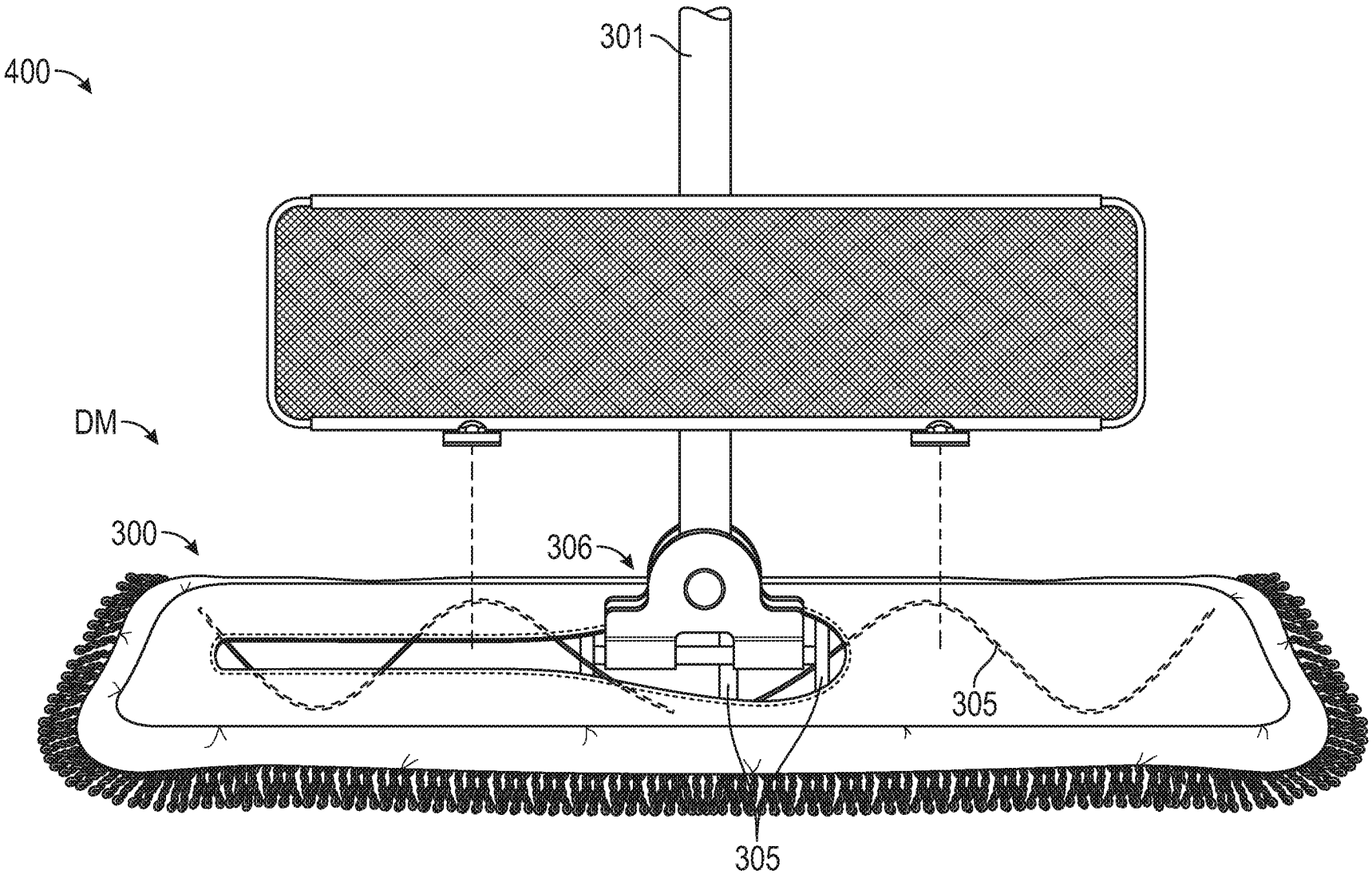
FIG. 9 is an in-use view of the device of FIG. 7, being installed on a conventional dust mop with a pivotal/swing handle.

FIG. 9 is an in-use view of the device of FIG. 7, being installed on a conventional dust mop DM with a handle 301 connected to the mop head 300 by a pivotal connection 306, the handle longitudinally sliding in the slot 443 and the magnets 430 being lowered to connect magnetically to the frame 305 in the mop head 300.

Figure 10:
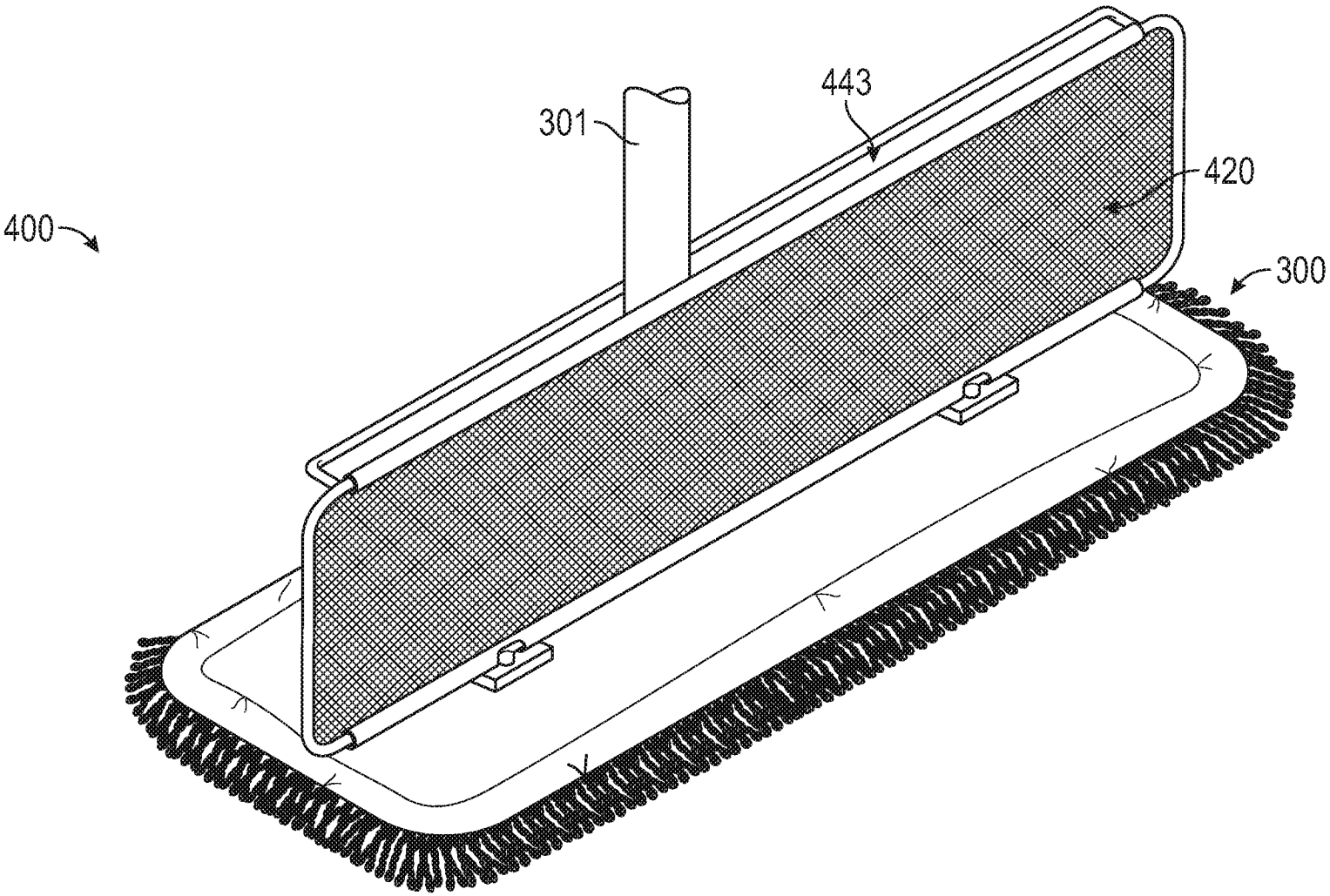
FIG. 10 is a front isometric view of the embodiment of FIG. 7 fully installed on the dust mop, with the dust mop handle in the slot of the device and perpendicular to the mop head top surface and the floor.

FIG. 10 is a front isometric view of the embodiment of FIG. 7 fully installed on the dust mop DM and with the dust mop handle 301 in the slot 443 of the device 400 and perpendicular to the mop head top surface and the floor. The front side of the trapping member is visible in this figure.

Figure 11:
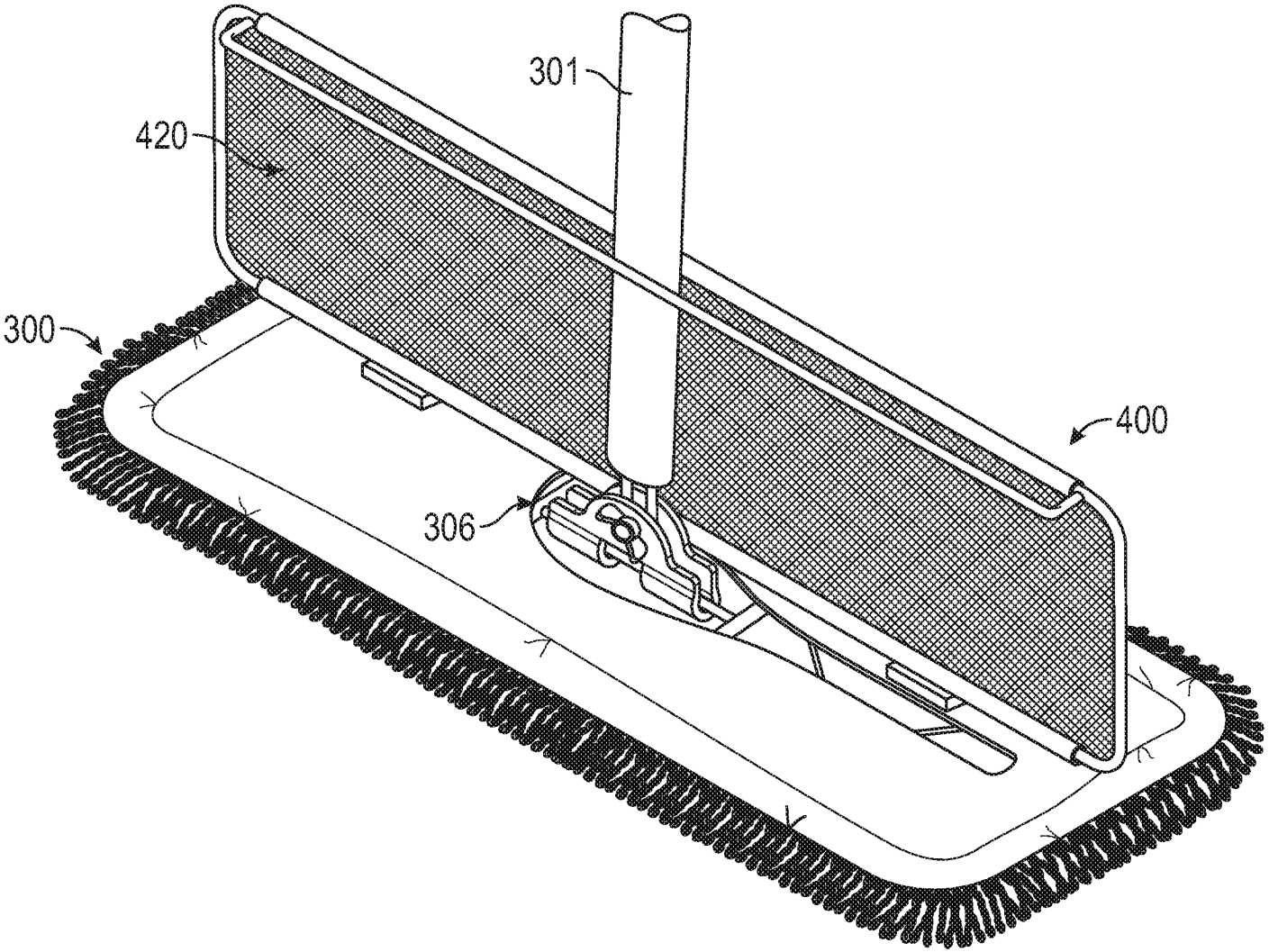
FIG. 11 is a rear isometric view of the dust mop embodiment of FIG. 10.

FIG. 11 is a rear isometric view of the dust mop embodiment of FIG. 10.

Figure 12:
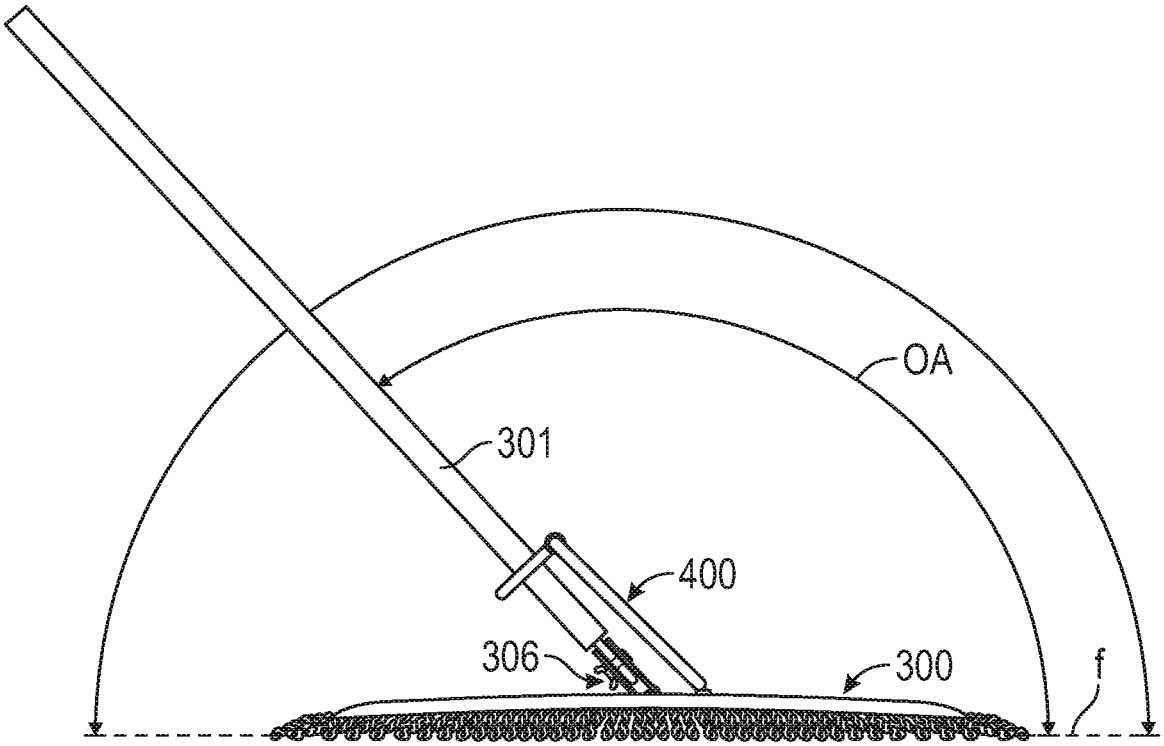
FIG. 12 is a right side view of the dust mop embodiment of FIG. 10, wherein the handle, and the device with it, have been swung rearward for use in dust-mopping in a forward direction.

FIG. 12 is a right side view of the dust mop embodiment of FIG. 10, wherein the handle, and the device with it, have been swung rearward for use in dust-mopping in a forward direction. FIG. 13 is a right side view of the dust mop embodiment of FIG. 10, wherein the handle, and the device with it, have been swung forward for use in dust-mopping in a direction opposite of FIG. 12. Note that the device 400 is effective for catching debris in both of the positions/orientations shown in FIGS. 12 and 13, and that the catching portion/trapping surface of the device 400 is generally parallel to the longitudinal axis of the handle in each of the positions shown in FIGS. 12 and 13. FIGS. 12 and 13 also include arrows illustrating that, in certain embodiments of the preferred pivotal connection 306, the handle 301 can pivot all the way forward and rearward to the floor (transverse to the length of the dusting head), to an extent that the outer end of the handle 301 touches the floor in front or behind the head 300 and the handle lies generally horizontal in front or behind the head 300. Thus, arrows in FIGS. 12 and 13 are drawn to illustrate a preferred handle's forward and rearward pivoting of 180 degrees, or slightly more than 180 degrees (for example, 181-185 degrees) if one takes into account the pivot axle of the handle being raised slightly above the floor by about the thickness of the head. It may be noted that in certain embodiments, the device 400 pivots forward and rearward with the handle, the same or about the same amount as the handle pivots relative to the dusting head; therefore, in certain embodiments, the device 400 pivots forward and rearward at least 180 degrees.

FIG. 14 is a rear view of the dust mop embodiment of FIG. 10, showing that the handle may be pivoted/swung sideways in the slot of the device, all the way to the right and left until the handle 301 reaches and impacts the ends 445, 446. Therefore, certain embodiments of the handle 301 are expected to pivot right and left to an extent that the handle will reach an angle SA to the floor in the range of about 25-45 degrees, as discussed above.

Figure 15:
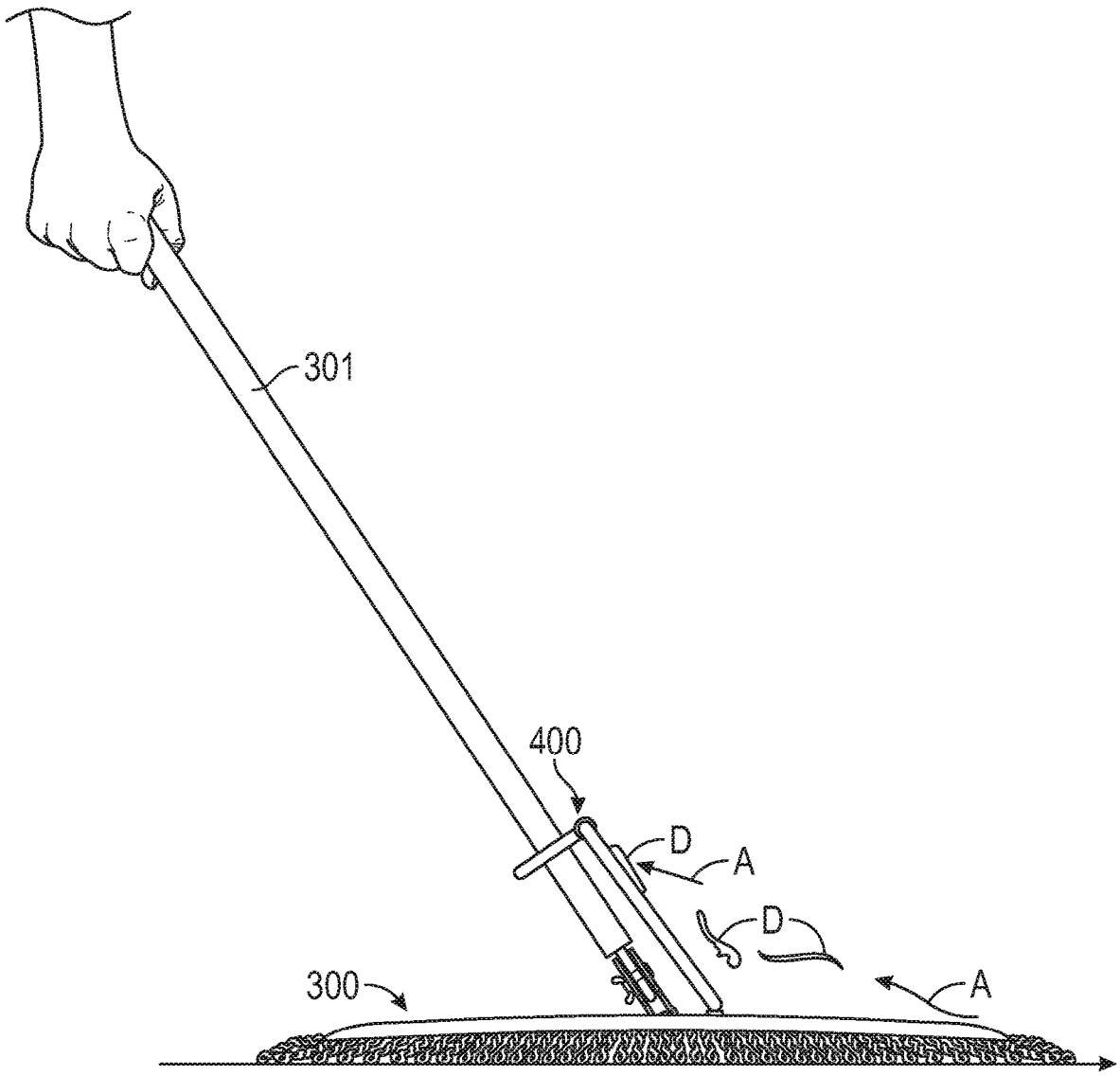
FIG. 15 is a right side view of the embodiment of FIG. 10, in use during forward dust mopping in a forward direction so that air wafts debris up and against the device's trapping surface.

FIG. 15 is a right side view of the embodiment of FIG. 10, in use during forward dust mopping in a forward direction so that air A wafts light-weight debris D up and against the device's trapping surface 420. As discussed above, light-weight debris D will tend to remain on the trapping surface 420 of the device 400 until the user chooses to remove it.

Figure 16:
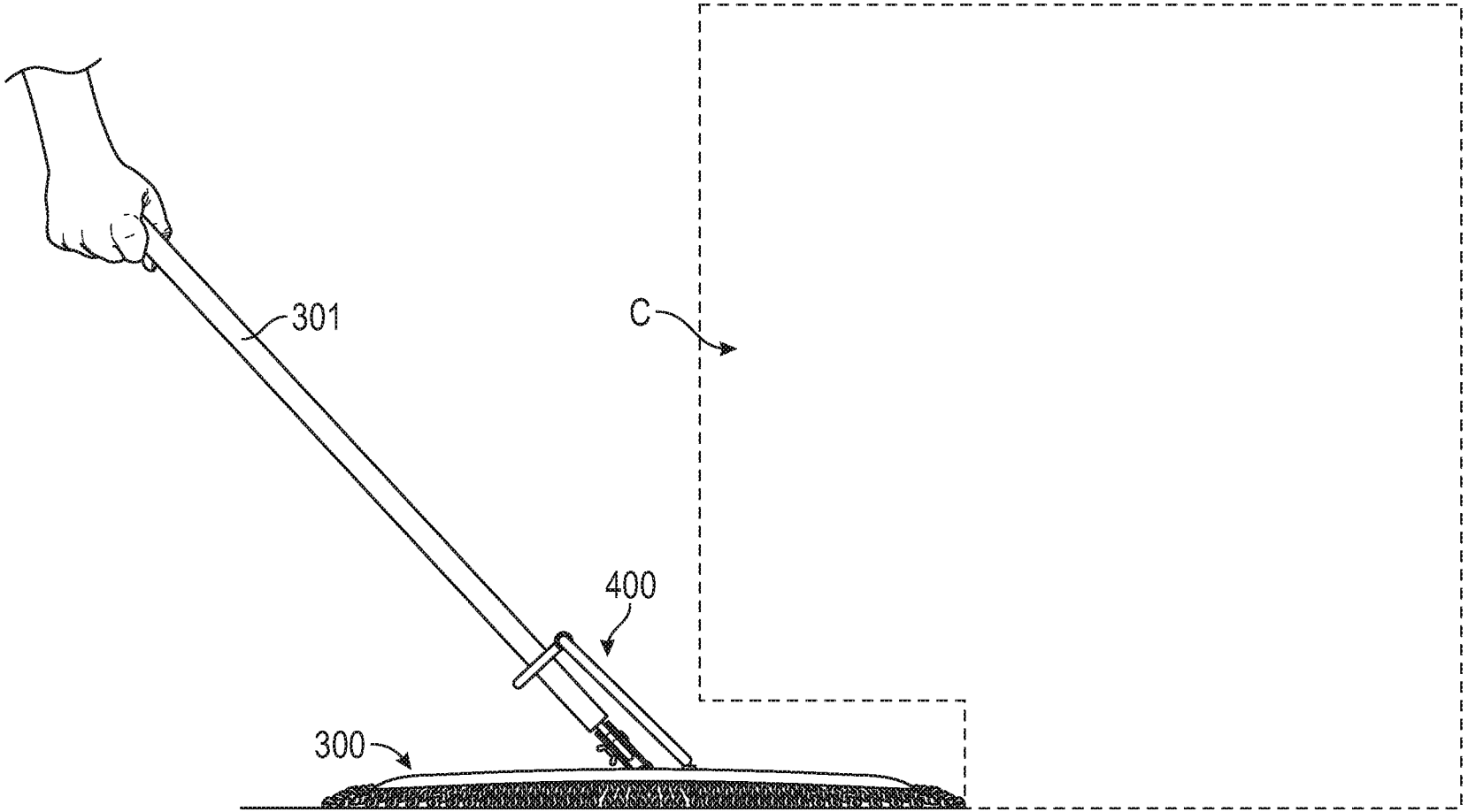
FIG. 16 is a right side view of the embodiment of FIG. 10, wherein the handle and device are pivoted/swung rearward, for pushing the dust mop under an exemplary structure, for example, a piece of furniture, case, or cabinet.

FIG. 16 is a right side view of the embodiment of FIG. 10, wherein the handle and device are pivoted/swung rearward, for pushing the dust mop under an exemplary structure C, for example, a piece of furniture, case, or cabinet.

Figure 17:
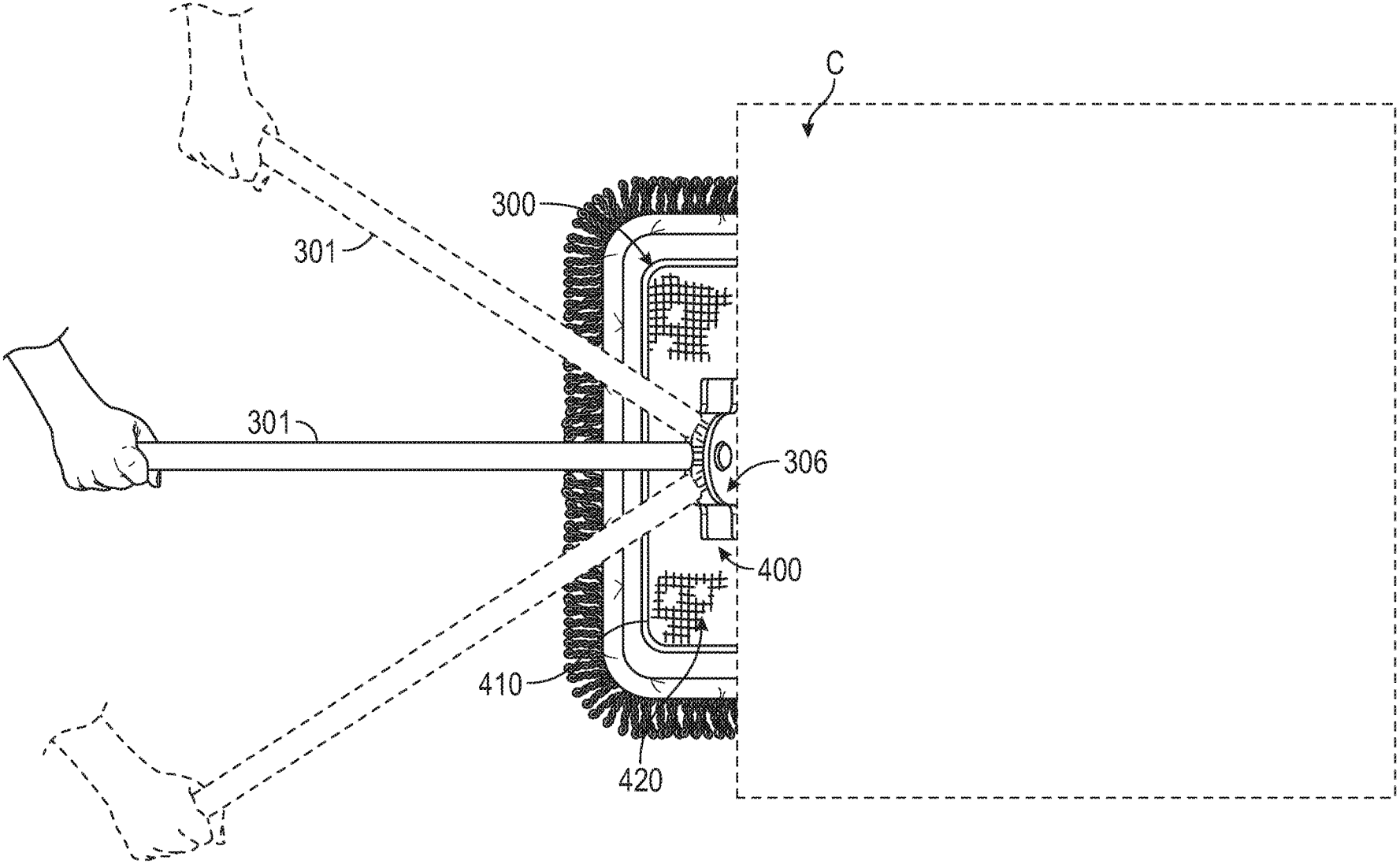
FIG. 17 is a top view of the embodiment of FIG. 10, with the dust mop being pushed under an exemplary structure similarly as in FIG. 16, and showing versatility of the dust mop embodiment in that the handle may further be pivoted/swung to the right and left.

FIG. 17 is a top view of the embodiment of FIG. 10, with the dust mop being pushed under an exemplary structure C similarly as in FIG. 16, and showing versatility of the dust mop embodiment in that the handle 301 may further be pivoted/swung to the left and right.

Figure 18:
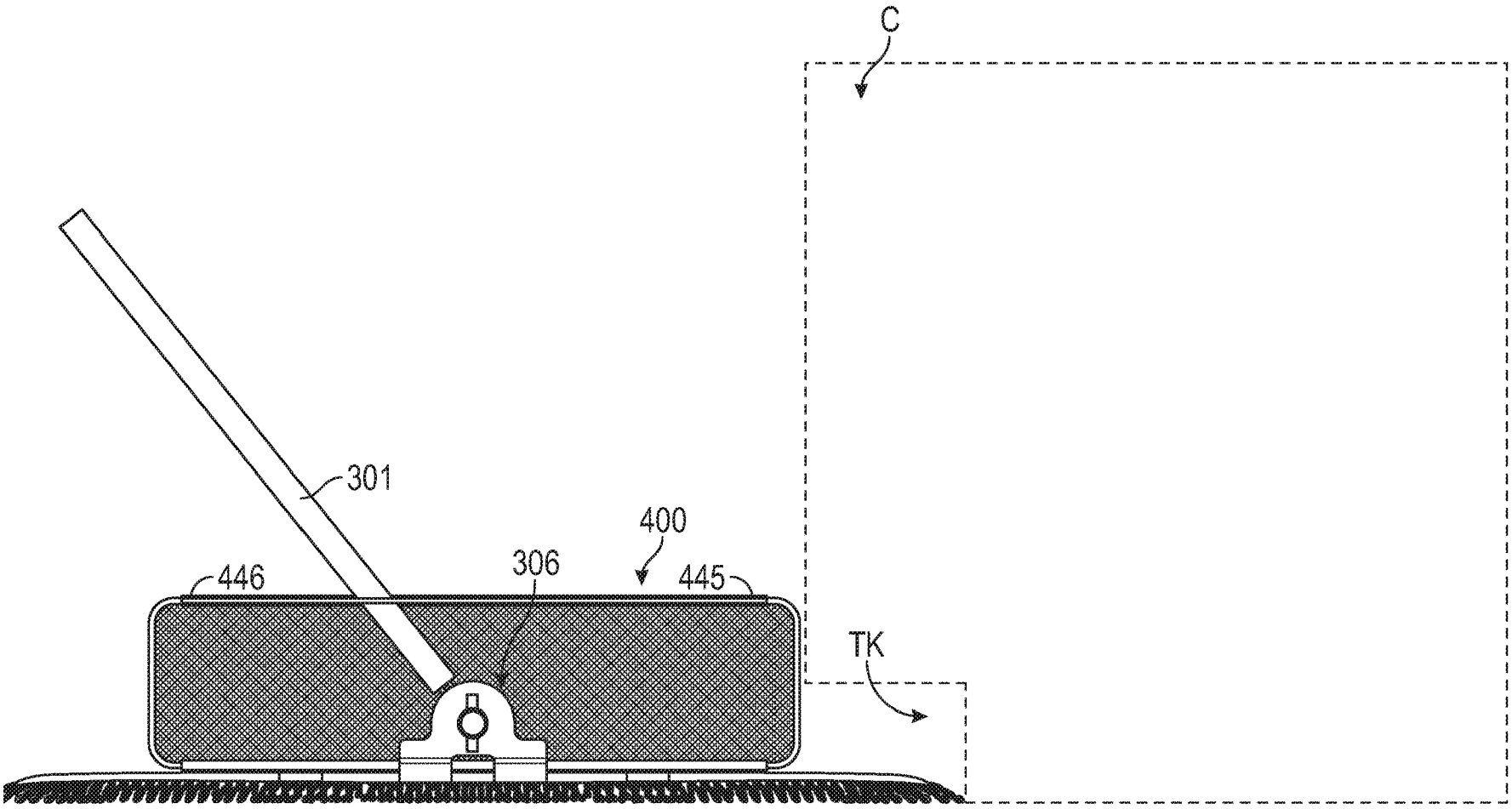
FIG. 18 is a rear view of the dust mop embodiment of FIG. 10, in use with the right end of the dust mop extending into the toe kick space of a piece of furniture, case, or cabinet.

FIG. 18 is a rear view of the embodiment of FIG. 10, wherein the user is pushing the dust mop forward along cabinet C that has a toe kick space TK. The right end of the dust mop head 300 extends into the toe kick space TK, while the device 400 moves along the vertical face of the cabinet C outside of the space TK, due to the shorten length of the device 400 relative to the head length. For example, the device 400 may be centered on the head 300 and may be a total of about 12-16 inches shorter than the head 300, so that 6-8 inches of the right end of the head 300 extends right past the device 400 and into the space TK. This way, the user can easily push the dust mop along the face of the cabinet C, moving parallel to the face of the cabinet (into the paper of FIG. 18), dusting the top kick space TK as well as the floor near the cabinet C, while the device 400 continues to catch debris that lies near the cabinet.

In the Summary of the Invention above, throughout the Detailed Description, and in the accompanying drawings, reference is made to particular features, including method steps, of certain embodiments of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally. Further, although this disclosed technology has been described above with reference to particular means, materials and embodiments, it is to be understood that the disclosed technology is not limited to these disclosed particulars and extends instead to all equivalents within the broad scope of this disclosure and of following claims.

What is claimed is:

1. A combination of a dust mop and a debris-catching device, the dust mop comprising a dusting head having two ends and a dusting head length between the two ends for placement of the dusting head on a floor with the dusting head length parallel to a floor, and the dust mop further comprising a handle pivotally connected to the dusting head, and the debris-catching device comprising:

a catching portion with a trapping surface for catching debris floating or rolling above the dusting head, the catching portion having a right end and a left end and a catching portion length between the right and left ends, a bottom edge and a top edge, and a vertical height between the bottom and top edges; and a connection system connecting the catching portion to the dust mop, the connection system comprising an upper connector comprising two elongated parallel connector members each having a connector member length parallel to the catching portion length and the dusting head length, wherein the two connector members are spaced-apart a consistent distance all along the connector member lengths to form an elongated slot at or near the top edge of the catching portion, wherein the elongated slot has a consistent width transverse to the connector members lengths and equal to the distance between the connector members whereby the handle is received in the slot and is pivotal, relative to the upper connector and the dusting head, right and left in the slot toward the right and left ends of the catching portion and toward the two ends of the dusting head.

2. The combination as in claim 1, wherein:

the handle is pivotal relative to the dusting head in forward and rearward directions that are transverse to the dusting mop length;

the connection system further comprises at least one lower mounting member at the bottom edge of the catching portion; and the lower mounting member detachably and pivotally connects the catching portion to a top surface of the dusting head, so that the catching portion is pivotal relative to the dusting head forward and rearward when the handle pivots forward and rearward relative to the dusting head.

3. The combination as in claim 2, wherein the dusting head comprises a metal frame and the at least one lower mounting member comprises a magnet detachably connecting the device to said metal frame.

4. The combination as in claim 2, wherein the handle is pivotal forward and rearward at least 180 degrees relative the dusting head, and the upper connector is adapted so that the catching portion is pivotal with the handle at least 180 degrees forward and rearward relative to the dusting head.

5. The combination as in claim 4, wherein the handle is pivotal right and left at least 90 degrees in the slot relative to the dusting head.

6. The combination as in claim 1, wherein the upper connector further comprises a right end bar and a left end bar forming a right extremity and a left extremity of the slot, so that the slot is adapted for the pivotal handle to pivot right and left in the slot between the two elongated parallel connector members as far as the right end bar and left end bar.

7. The combination as in claim 1, wherein said catching portion comprises a catching portion frame around an outer perimeter of the trapping surface, wherein the trapping surface has a front side and a rear side both adapted to catch the debris floating or rolling above the dusting head and toward said front side or rear side.

8. The combination as in claim 7, wherein the catching portion frame comprises one of said two elongated parallel connector members.

9. The combination as in claim 7, wherein the catching portion frame and the trapping surface are extendible in length.

10. The combination as in claim 1, wherein the upper connector comprises no clamp, bolt, or fastener that fixes the upper connector to the handle.

11. The combination as in claim 1, wherein the handle is pivotal right and left at least 90 degrees in the slot relative to the dusting head.

12. The combination as in claim 1, wherein the catching portion length is 65-80% of the dusting head length, so that the two ends of the dusting head extend longitudinally past the catching portion.

13. A combination of a dust mop and a debris-catching device, the dust mop comprising a dusting head having right and left ends and a dusting head length between the right and left ends for placement of the dusting head on a floor with the dusting head length parallel to a floor, and the dust mop further comprising a handle pivotally connected to the dusting head, and the debris-catching device comprising:

a catching portion upending from the dusting head for catching debris floating or rolling above the dusting head, the catching portion comprising an upper connector having an elongated slot with right and left slot ends and a slot length extending between the right and left slot ends and parallel to the dusting head length, and a width transverse to the slot length and the dusting head length, the width of the slot being consistent between the right and left slot ends, and the slot slidably receiving the handle so that the handle is pivotal, relative to the right and left ends of the dusting head;

wherein the handle is pivotal forward and rearward relative to the dusting head and the device further comprises at least one lower connector that pivotally connects the catching portion to a top surface of the dusting head so that the catching portion is pivotal forward and rearward with the handle relative to the dusting head.

14. A combination of a dust mop and a debris-catching device, the dust mop comprising a dusting head having right and left ends and a dusting head length between the right and left ends for placement of the dusting head on a floor with the dusting head length parallel to a floor, and the dust mop further comprising a handle pivotally connected to the dusting head so that the handle is pivotal left and right, and forward and rearward, relative to the dusting head, wherein the debris-catching device comprises:

a catching portion upending from the dusting head for catching debris floating or rolling above the dusting head, the catching portion comprising an upper connector having an elongated slot with right and left slot ends and a slot length extending between the right and left slot ends and parallel to the dusting head length, and the slot slidably receiving the handle so that the handle slides left and right in the slot, to pivot toward the right and left ends of the dusting head, respectively; and wherein the device further comprises at least one lower connector that pivotally connects the catching portion to a top surface of the dusting head so that the catching portion is pivotal forward and rearward with the handle when the handle pivots forward and rearward relative to the dusting head.

15. The combination as in claim 14 wherein the at least one lower connector comprises a magnet for detachably connecting the device to a metal frame of the dusting head.

16. The combination as in claim 14, wherein the upper connector comprises a right end bar and a left end bar at the right and left slot ends, respectively, so that the slot is adapted for the pivotal handle to pivot right and left in the slot as far as the right end bar and left end bar.

17. The combination as in claim 14, wherein said catching portion comprises a catching portion frame and a planar trapping member in the catching portion frame, wherein the trapping member has a front side and a rear side both adapted to catch the debris floating or rolling above the dusting head and toward said front side or rear side.

18. The combination as in claim 14, wherein the upper connector comprises no clamp, bolt, or fastener that fixes the upper connector to the handle.

19. The combination as in claim 14, wherein the handle is pivotal right and left at least 90 degrees in the slot relative to the dusting head.

20. The combination as in claim 14, wherein the handle is pivotal forward and rearward at least 180 degrees relative the dusting head, and the upper connector is adapted so that the catching portion is pivotal with the handle at least 180 degrees forward and rearward relative to the dusting head.

21. The combination as in claim 20, wherein the handle has a length and the upper connector comprises a frame member, an armature member parallel to the frame member, and a right end bar and a left end bar at the right and left slot ends, wherein the handle slides in the slot, in a direction parallel to the length of the handle, relative to the frame member and armature member, when the handle pivots forward and rearward.

* * * * *